United States Patent [19]

Lipton

[11] Patent Number: 4,478,272

[45] Date of Patent: Oct. 23, 1984

[54] METHOD FOR CONTINUOUS CASTING OF STEEL STRANDS, ESPECIALLY SLABS

[75] Inventor: Jan Lipton, Wädenswil, Switzerland

[73] Assignee: Concast AG, Zürich, Switzerland

[21] Appl. No.: 310,729

[22] Filed: Oct. 13, 1981

[30] Foreign Application Priority Data

Oct. 30, 1980 [CH] Switzerland ..... 8071/80

[51] Int. Cl.[3] ..... B22D 27/02

[52] U.S. Cl. ..... 164/454; 164/468

[58] Field of Search ..... 164/468, 454, 484

[56] References Cited

U.S. PATENT DOCUMENTS 3,981,345 9/1976 Alberny et al. ..... 164/468

*Primary Examiner*—Kuang Y. Lin

*Attorney, Agent, or Firm*—Werner W. Kleeman

[57] ABSTRACT

A method for continuous casting steel, wherein the liquid core is stirred at the region of the mold. The electromagnetic forces are altered as a function of the change in the strand withdrawal speed.

5 Claims, No Drawings

METHOD FOR CONTINUOUS CASTING OF STEEL STRANDS, ESPECIALLY SLABS

BACKGROUND OF THE INVENTION

The present invention relates to a new and improved method for the continuous casting of steel strands, especially slabs, wherein the liquid core or pool is stirred by the action of electromagnetic forces at the region of the continuous casting mold.

During the continuous casting of steel, especially larger strand sectional shapes or formats, there arise during the course of the casting time fluctuations or changes in the withdrawal speed of the cast strand, which are predicated upon different causes. Thus, it is known in conventional practice to slow down the withdrawal speed of the strand or even to reduce such to null i.e. to stop the strand at the end of the casting or pouring operation. Thereafter the slag is removed from the molten level or meniscus of the strand end still located in the continuous casting mold and water is sprayed so that the steel at the region of the bath level or meniscus is solidified. Below this solidified bath level there is, however, formed a hollow space due to the shrinkage effects of the strand. Due to the formation of bridges or the like, particularly between the wide sides of the mold when casting slab formats or sectional shapes, there is hindered any further flow of the molten metal, so that there can be formed hollow spaces which extend through a length of over one meter. Since this length must be cut off before further processing of the strand there arise appreciable losses in the ouput or yield of the continuously cast strands.

Further fluctuations in the strand withdrawal speed arise, for instance, when performing sequential pours or casting operations, during which the teeming or pouring operation is slowed down when there is accomplished a change in the ladle or tundish. Moreover, changes in the withdrawal speed of the continuously cast strand arise when altering the slab width by adjusting the narrow sides of the mold during the continuous casting operation or when there occurs metal break-out, or when there arise other disturbances in the casting operation during which the strand must be stopped.

It is generally known in the continuous casting art to stir the liquid core or pool within the solidified strand shell or skin at the region of the continuous casting mold by stirrers arranged at the height of the continuous casting mold or therebelow. These stirrers stir the liquid pool of the cast strand by the application of electromagnetic forces. During the casting events discussed above, where as previously explained there arises a slowing down of the withdrawal speed or a stopping of the continuously cast strand, the residence time of the cast strand within the effective region of the electromagnetic stirrer is greater than during the time of the fully effective static casting operation.

Now if the strand, upon the occurrence of such operating events, is stirred in the same manner as during normal operations then there arises a local "over-stirring" of the continuously cast strand, i.e. it is stirred for much too great amount of time at the same section of the cast strand. In this case when etching a cross-section of the strand or taking of a sulphur print of the strand cross-section, there has been noticed a pronounced transition between the outer zone which has already solidified at the time of stirring and the inner situated globulitic zone. This pronounced transition is optically discernible at the rolled product, and therefore undesired and impairs the quality of the casting. Moreover, also at the end of the casting operation difficulties can therefore arise because the intentional solidification of the metal located at the region of the meniscus or bath level is disturbed, because the thin formed strand shell at the end of the strand tends to melt by virtue of the flow of hot steel which has been moved to the region of the strand shell by virtue of the pronounced stirring or agitation of the molten metal. This increases the danger of a metal break-out during the subsequent withdrawal of the cast strand.

SUMMARY OF THE INVENTION

Therefore, with the foregoing in mind it is a primary object of the present invention to provide a new and improved method of continously casting steel strands, especially slabs, in a manner not afflicted with the aforementioned drawbacks and limitations of the prior art proposals.

Another and more significant object of the present invention aims at improving the yield of the cast steel during the continuous casting of strands, wherein, however, there is avoided the aforementioned drawbacks, especially the "over-stirring" of the strand in order to increase the quality of the cast product.

Now in order to implement these and still further objects of the invention, which will become more readily apparent as the description proceeds, the method of the present development for continuously casting steel strands, especially slabs is manifested by the features that the electromagnetic forces are altered in accordance with the change in the magnitude of the withdrawal speed of the cast strand.

In this way there is insured that during change in the withdrawal speed of the casting, for instance at the end of the casting or pouring operation, there can be obtained an increased yield, without there arising undesired pronounced transitions between the outer zone and the globulitic zone of the cast strand.

An advantageous solution for altering the electromagnetic forces causing movement of the molten bath or molten pool of metal is obtained by controlling the stirrer output or powering. Another proposal resides in, for instance, changing the spacing of the stirrer from the continuously cast strand.

The stirrer power or output can be altered by changing the flow of current through the stirrer and/or the voltage applied to the stirrer. When using asymmetrically powered stirrer coils or phases, as disclosed in the European Patent Publication No. 0008376, published Mar. 5, 1980 or in the commonly assigned copending U.S. application Ser. No. 06/057,407, filed July 13, 1979, it is advantageous to control the stirrer output by controlling the stirrer current, because the ratio of the asymmetry of current intensities through the multiphases of the electromagnetic stirrer can be simply regulated so as to be maintained in a constant relationship. This insures maintaining an optimum preselected asymmetry in the phases of the multi-phase electromagnetic stirrer. This produces a turbulence which is necessary in order to avoid the occurrence of the socalled "white bands or lines" otherwise noticed at the cast strand.

DETAILED DESCRIPTION OF THE PREFERRED EMBODIMENTS

Describing now the invention in greater detail, a stirrer which is effective transversely with respect to the direction of travel of the continuously cast strand is arranged in a continuous casting installation for casting a steel slab having the cross-sectional dimensions of 2,100×225 cm. The multi-phase electromagnetic stirrer, which may be of conventional design, and may be for instance constructed as disclosed in the aforementioned U.S. application Ser. No. 06/057,047, is arranged beneath the mold at a spacing of approximately four meters from the end of the continuous casting mold. During the start of the continuous casting operation the withdrawal speed of the cast strand which is governed by the driven withdrawal rolls of a standard withdrawal machine is increased to a value of about 0.8 m/min. As soon as the dummy bar head, which establishes the connection to the hot strand, passes the height of the electromagnetic stirrer the latter is turned-on. The stirrer output or power which produces the electromagnetic forces used for stirring can be regulated by adjusting the intensity of the current flowing through the coil windings or phases to a desired magnitude. The flow of the stirred molten steel which extends up into the molten bath level or meniscus region of the molten metal in the continuous casting mold is caused by the action of an electromagnetic travelling field. In order to generate this travelling field there is provided a multi-phase electromagnetic stirrer, typically for instance a two-phase stirrer. The energization current for the one phase of the stirrer amounts to about 800 amperes and for the other phase of the stirrer to about 1000 amperes, i.e. as previously mentioned, the phases of the electromagnetic stirrer may be asymmetrically powered or operated. However, the phases of the stirrer also could be symmetrically powered. Both phases are powered by a voltage amounting to about 200 volts and a frequency of approximately 2 Hz.

During the casting operation which is in progress at this time and with constant strand withdrawal speed the stirrer output or power is proportionally regulated, for instance as a function of the magnitude of the strand withdrawal speed. There is also possible a stepwise accommodation of the stirrer output or power to the changing magnitude of the strand withdrawal speed. At the end of the casting or pouring operation, following a casting time of approximately one hour, the emptied ladle is pivoted away and, after emptying the tundish, the strand withdrawal speed is reduced to null. In proportion thereto, there is also reduced to null the stirrer output or power by adjusting a reference value transmitter at both supply or powering devices which furnish the energization current to the phases of the electromagnetic stirrer. With the inventive regulation of the stirrer output or power both of the energization or excitation currents flowing through the phases of the two-phase electromagnetic stirrer are regulated in a manner such that their ratio to one another remains essentially constant.

Within approximately two minutes the stationary strand is closed, i.e. after removal of the slag residues by spraying of water onto the strand there is produced a cover formed of solidified steel. Thereafter, the slab is removed while increasing the strand withdrawal speed and in proportion thereto also the stirrer output or power.

Since by virtue of the above-explained reduction in the stirrer output or power there does not arise any movement of the metal at the region of the molten bath level or meniscus, there is not disturbed the formation of this thin shell at the end of the continuously cast strand and there are not entrained into the interior of the cast strand slag particles. This results in an increase in the purity of the last portion of the cast strand.

Also, by avoiding any over-stirring of the cast strand there no longer arise the undesired pronounced transitions between the initially solidified outer strand shell or skin and the internal globulitic zone. When restarting the strand and upon renewed increase of the stirrer output or power as a function of the magnitude of the strand withdrawal speed there is produced internally of the strand a sufficiently intense stirrer flow i.e. flow of the stirred molten metal, which beneficially avoids the formation of prolonged or lengthy extending contraction hollow spaces or voids. This produces an increased yield and quality in the cast product.

A particularly simple regulation which can be accomplished within the teachings and scope of the invention resides in shutting down the electromagnetic stirrer whenever there is exceeded a predetermined strand withdrawal speed, for instance by 80%. During a subsequent exceeding of the upper threshhold or limit of the strand withdrawal speed there is then accomplished a renewed starting of the electromagnetic stirrer. This so-called on-point regulation only requires a very small or modest amount of equipment expenditure.

If during a sequential casting or pouring operation there is cast in succession steel of different compositions from a number of ladles, then it is conventional practice to insert into the continuous casting mold separation or partition plates between the steel emanating from the different charges, in order to avoid the formation of a long transition section or piece at the continuously cast strand. This requires a reduction in the strand withdrawal speed. Also in this case it is possible to correspondingly alter the stirrer output or power, so that there neither arises any disturbance in the requisite work at the region of the molten bath level or meniscus nor any local overstirring of the molten metal.

While there have been described present preferred embodiments of the invention, it is to be distinctly understood that the invention is not limited thereto, but may be otherwise variously embodied and practiced within the scope of the following claims. Accordingly,

What is claimed is:

1. A method of continuously casing strands formed of steel, especially steel slabs, comprising the steps of:

continuously casting molten metal in a continuous casting mold to form a continuously cast strand having a liquid core;

withdrawing the continuously cast strand from the continuous casting mold;

stirring the liquid core of the continuously cast strand at the region of the continuous casting mold by the action of electromagnetic forces; and altering the electromagnetic forces in the same sense and in correspondence to the changes in the magnitude of the strand withdrawal speed.

2. The method as defined in claim 1, further including the steps of:

stirring the liquid core at the region of the continuous casting mold by an electromagnetic stirrer; and altering the electromagnetic forces by controlling the stirrer output.

3. The method as defined in claim 2, further including the steps of:

controlling the stirrer output by altering the flow of current through phases of the electromagnetic stirrer.

4. The method as defined in claim 3, further including the steps of:

using an electromagnetic stirrer having asymmetrically powered phases; and regulating in an essentially constant manner the ratio of the energization currents flowing through the phases of the electromagnetic stirrer.

5. The method as defined in claim 3, further including the steps of:

using an electromagnetic stirrer having two asymmetrically powered phases; and regulating in an essentially constant manner the ratio of the energization currents flowing through both of the phases of the electromagnetic stirrer.

* * * * *